US005581281A

United States Patent [19]

Fuse

[11] Patent Number: 5,581,281

[45] Date of Patent: Dec. 3, 1996

[54] INK-JET RECORDING APPARATUS HAVING DRIVE PULSE WIDTH CONTROL DEPENDENT ON PRINTHEAD TEMPERATURE

[75] Inventor: Takeshi Fuse, Ebina, Japan

[73] Assignee: Fuji Xerox Co., Ltd., Tokyo, Japan

[21] Appl. No.: 87,290

[22] Filed: Jul. 8, 1993

[30] Foreign Application Priority Data

Jul. 14, 1992 [JP] Japan ..... 4-210833

[51] Int. Cl.[6] ..... B41J 29/38

[52] U.S. Cl. ..... 347/14; 347/12; 347/17; 347/35

[58] Field of Search ..... 347/9, 10, 11, 347/12, 13, 14, 17, 35, 60

[56] References Cited

U.S. PATENT DOCUMENTS

| | | | |
|---|---|---|---|
| 4,791,435 | 12/1988 | Smith et al. | 347/60 |
| 4,970,527 | 11/1990 | Gatten | 347/35 |
| 5,172,134 | 12/1992 | Kishida et al. | 347/13 |

FOREIGN PATENT DOCUMENTS

| | | | |
|---|---|---|---|
| 61-146548 | 7/1986 | Japan | 347/60 |
| 62-179945 | 8/1987 | Japan . | |
| 64-38246 | 2/1989 | Japan . | |
| 3-227643 | 10/1991 | Japan | 347/14 |
| 4-44856 | 2/1992 | Japan . | |
| 4-47948 | 2/1992 | Japan | 347/13 |
| 5-31899 | 2/1993 | Japan | 347/13 |

*Primary Examiner*—John E. Barlow, Jr.
*Attorney, Agent, or Firm*—Oliff & Berridge

[57] ABSTRACT

An ink-jet recording apparatus quickly completes a preparatory driving operation, and suppresses the wasteful consumption of the ink even if the apparatus is used in a cold environment after the apparatus has been held inoperative for a long time. The ink-jet recording apparatus comprises a first storage for storing a first driving pulse width data, a second storage for storing a second driving pulse width data, and a plurality of driving pulse generating units. A data selecting unit selects either the first driving pulse width data or the second driving pulse width data according to selection data set by a dot counter control unit, and a print pulse width setting unit and the driving pulse generating units generate ink-jet print head driving pulses. A print data processing unit produces print data for driving the nozzles of the ink-jet print head. The first and second driving pulse width data is used selectively and the print data is produced according to the time for which the ink-jet recording apparatus has been held inoperative and the temperature of the ink-jet print head.

3 Claims, 9 Drawing Sheets

INK-JET RECORDING APPARATUS HAVING DRIVE PULSE WIDTH CONTROL DEPENDENT ON PRINTHEAD TEMPERATURE

BACKGROUND OF THE INVENTION

1. Field of the Invention

The present invention relates to an ink-jet recording apparatus that jets ink particles toward a recording medium to form characters on the recording medium in a dot-matrix format and, more particularly, to the preparatory driving and control of the print head of such an ink-jet recording apparatus.

2. Description of the Prior Art

There has been proposed an ink-jet recording apparatus that heats the ink by a heater to produce bubbles in the ink and to expand the bubbles so that the ink is jetted by the pressure of the expanding bubbles through the discharge nozzle of an ink-jet print head toward a recording medium for recording. The discharge nozzles of such an ink-jet recording apparatus is always filled up with the ink and the ink filling up the discharge nozzles dries when the ink-jet recording apparatus is not used for a certain period of time. Therefore, the ink-jet recording apparatus is provided with a covering mechanism for covering the discharge nozzles. However, it is very difficult to cover the discharge nozzles hermetically by the covering mechanism and, when the ink-jet recording apparatus is not used for a long time, moisture and volatile components of the ink evaporates gradually to change the physical properties of the ink and to increase the viscosity of the ink, so that the ink cannot be easily discharged through the discharge nozzles when the ink-jet recording apparatus is operated after a long inoperative state. Accordingly, if the ink-jet recording apparatus is operated for printing with the ink in such a condition, the ink filling up the discharge nozzles cannot be discharged or the flying direction of ink particles is unstable even if the ink is discharged, causing unsatisfactory printing and the deterioration of print quality.

Such a problem arises when the ink-jet recording apparatus is held inoperative in a cold environment as well as when the same is used after being left inoperative for a long time. Since the temperature of the print head is controlled at an optimum temperature during printing operation, stable printing operation is possible. However, since the temperatures of the print head and the ink decrease and the viscosity of the ink increases if the ink-jet recording apparatus is held in an inoperative state for a long time, unsatisfactory printing results, characters of insufficient density are printed due to the reduction of ink particles and print quality is deteriorated when the ink-jet recording apparatus is used in a cold environment as well as when the ink-jet recording apparatus is left inoperative for a long time.

Accordingly, it is essential to maintain the inherent physical properties of the ink stably regardless of the variation of the ambient temperature and the term of inoperative state to the satisfactory operation of the ink-jet recording apparatus and various methods to avoid unsatisfactory printing have been proposed. One of those previously proposed methods drives the print head to prepare the print head for smooth discharge of the ink prior to starting printing operation.

A method to avoid unsatisfactory printing proposed in Japanese Patent Laid-open (Kokai) No. 62-179945 drives a print head by a number of preparatory driving cycles set beforehand by a print head driving cycle setting means before starting printing operation. Since substantially no other control operation is executed during the preparatory operation of the print head, the number of preparatory driving cycles can be controlled successfully by a central processing unit (CPU). However, the preparatory driving cycle needs to be repeated by a comparatively large number of times to heat the print head at a specified temperature when the ink-jet recording apparatus is installed in a cold environment, which requires a complex control means for controlling the number of preparatory driving cycles, such as a counter, and hardware of complex configuration that increase the cost of the ink-jet recording apparatus. Such a disadvantage may be overcome by setting an upper limit number of preparatory driving cycles. However, such a means needs to reactivate the CPU every time the number of preparatory driving cycles is set and hence the load on the CPU is not reduced effectively and the print head driving cycle setting means is not very advantageous.

A control method disclosed in Japanese Patent Laid-open (Kokai) No. 64-38246 drives a print head to a degree at which the print head will not jet the ink or drives the print head so as to jet the ink, or drives the print head to a degree at which the print head will not jet the ink and then drives the print head so as to jet the ink prior to starting the ink-jet recording apparatus, when the viscosity of the ink is excessively high or the temperature of the print head is lower than a specified temperature. This control method can be readily carried out by a control circuit disclosed in Japanese Patent Laid-open (Kokai) No. 62-179945. Although the viscosity of the ink filling up the discharge nozzles can be reduced by driving the print head to a degree at which the print head will not jet the ink, the moisture and volatile components of the ink prevailing in the vicinity of the discharge nozzles are evaporated and the density of characters printed in the initial stage of printing operation becomes excessively high. If the print head is driven for a preparatory operation so as to jet the ink, the ink is wasted. Although the method that drives the print head to a degree at which the ink is not discharged and then drives the print head to discharge the ink is able to eliminate the foregoing disadvantages, the preparatory driving operation requires much time when the ink-jet recording apparatus is used in a cold environment because the two steps of control operation must be successively carried out.

If the print head has a comparatively large heat capacity, it requires much time to heat the print head to a temperature at which the physical properties of the ink is stabilized. Therefore, a method disclosed in Japanese Patent Laid-open (Kokai) No. 4-44856 drives a print head for a preparatory operation at a driving frequency higher than that at which the print head is driven during printing operation. This method, however, increases the power consumption of a heater for heating the print head, which, under some circumstances, requires a power supply of an increased capacity that increases the cost of the ink-jet recording apparatus and is unable to reduce the time necessary for heating the print head to a desired temperature effectively. Furthermore, when the ink-jet recording apparatus is used in a cold environment, the number of preparatory ink discharge cycles must be increased, so that the ink is wasted.

SUMMARY OF THE INVENTION

Accordingly, it is an object of the present invention to provide an ink-jet recording apparatus having an ink-jet print head, capable of suppressing a wasteful consumption of the ink and of quickly completing the preparatory operation of the print head even if the ink-jet recording apparatus is held inoperative for a long time or the ink-jet recording apparatus is operated in a cold environment.

An ink-jet recording apparatus in a first aspect of the present invention comprises a carriage that moves relative to a recording medium, and an ink-jet print head detachably mounted on the carriage and having a plurality of discharge nozzles divided into a plurality of nozzle groups which are driven sequentially at predetermined time intervals to print characters on a line parallel to the direction of arrangement of the discharge nozzles, and the ink-jet recording apparatus is characterized by a first storage means for storing first driving pulse width data for driving the groups of the discharge nozzles, a second storage means for storing second driving pulse width data for driving the groups of the discharge nozzles, driving pulse generating units for generating pulse signals on the basis of either the first driving pulse width data or the second driving pulse width data to drive the corresponding ink-jet print cartridge among those of the ink-jet print head, respectively.

In an ink-jet recording apparatus in a second aspect of the present invention, the first driving pulse width data stored in the first storage means is the data for driving the ink-jet print head so that the ink is discharged, and the second driving pulse width data is the data for driving the ink-jet print head so that the ink will not be discharged.

In an ink-jet recording apparatus in a third aspect of the present invention, each driving pulse generating unit uses either the first driving pulse width data for driving the ink-jet print head so that the ink is discharged stored in the first storage means or the second driving pulse width data for driving the ink-jet print head so that the ink will not be discharged stored in the second storage means selectively to drive the corresponding nozzle group, and each of the first and second driving pulse width data is used at least once while all the plurality of groups of discharge nozzles of the ink-jet print head are driven.

In an ink-jet recording apparatus in a fourth aspect of the present invention, print data representing characters to be printed with each nozzle group driven on the basis of the driving pulse width data stored in either the first storage means or the second storage means can be optionally set.

In an ink-jet recording apparatus in a fifth aspect of the present invention, each of the plurality of discharge nozzles of each ink-jet print cartridge is driven only once when an external control unit requests driving the ink-jet print cartridge once for a preparatory operation.

In the first aspect of the present invention, either the first driving pulse width data or the second driving pulse width data is used selectively to generate a driving pulse signal of a pulse width specified by the first or second driving pulse width data to drive each nozzle group for a preparatory operation. Therefore, the ink-jet recording apparatus can be controlled for a preparatory operation in a control mode appropriate to starting the ink-jet recording apparatus under specific environmental conditions.

In the second aspect of the present invention, since the first driving pulse width data is determined so that the ink-jet print cartridge discharges the ink when the same is used, and the second driving pulse width data is determined so that the ink-jet print cartridge will not discharge the ink when the same is used, the ink-jet print cartridges can be driven for either a preparatory operation for removing a portion of the ink having an excessively high viscosity or a preparatory operation only for raising the temperature of the ink without discharging the ink, simply by selectively using either the first driving pulse width data or the second driving pulse width data.

In the third aspect of the present invention, since each of the first and second driving pulse width data is used at least once while all the nozzle groups of the ink-jet print head are driven for a preparatory operation, the ink-jet print head can be driven for both the preparatory operation to discharging part of the ink and the preparatory operation only to heat the ink without discharging the ink, so that the preparatory operation of the ink-jet print head can be quickly completed.

In the fourth aspect of the present invention, since print data can be optionally assigned to the nozzle groups, the number and position of the discharge nozzles to be driven can be determined, so that the temperature of the ink-jet print head can be minutely controlled.

In the fifth aspect of the present invention, since each of the plurality of nozzles of each ink-jet print cartridge is driven only once for a preparatory operation in response to a request of the external control unit for driving the same ink-jet print cartridge once for a preparatory operation, each print cartridge can be properly driven for a preparatory operation according to the condition of the same, and the temperature of the individual ink-jet print cartridge can be controlled by the external control unit.

BRIEF DESCRIPTION OF THE DRAWINGS

The above and other objects, features and advantages of the present invention will become more apparent from the following description taken in connection with the accompanying drawings, in which:

FIG. 1 is a block diagram of a system including an ink-jet recording apparatus in a preferred embodiment according to the present invention;

DETAILED DESCRIPTION OF THE PREFERRED EMBODIMENTS

Figure 9:
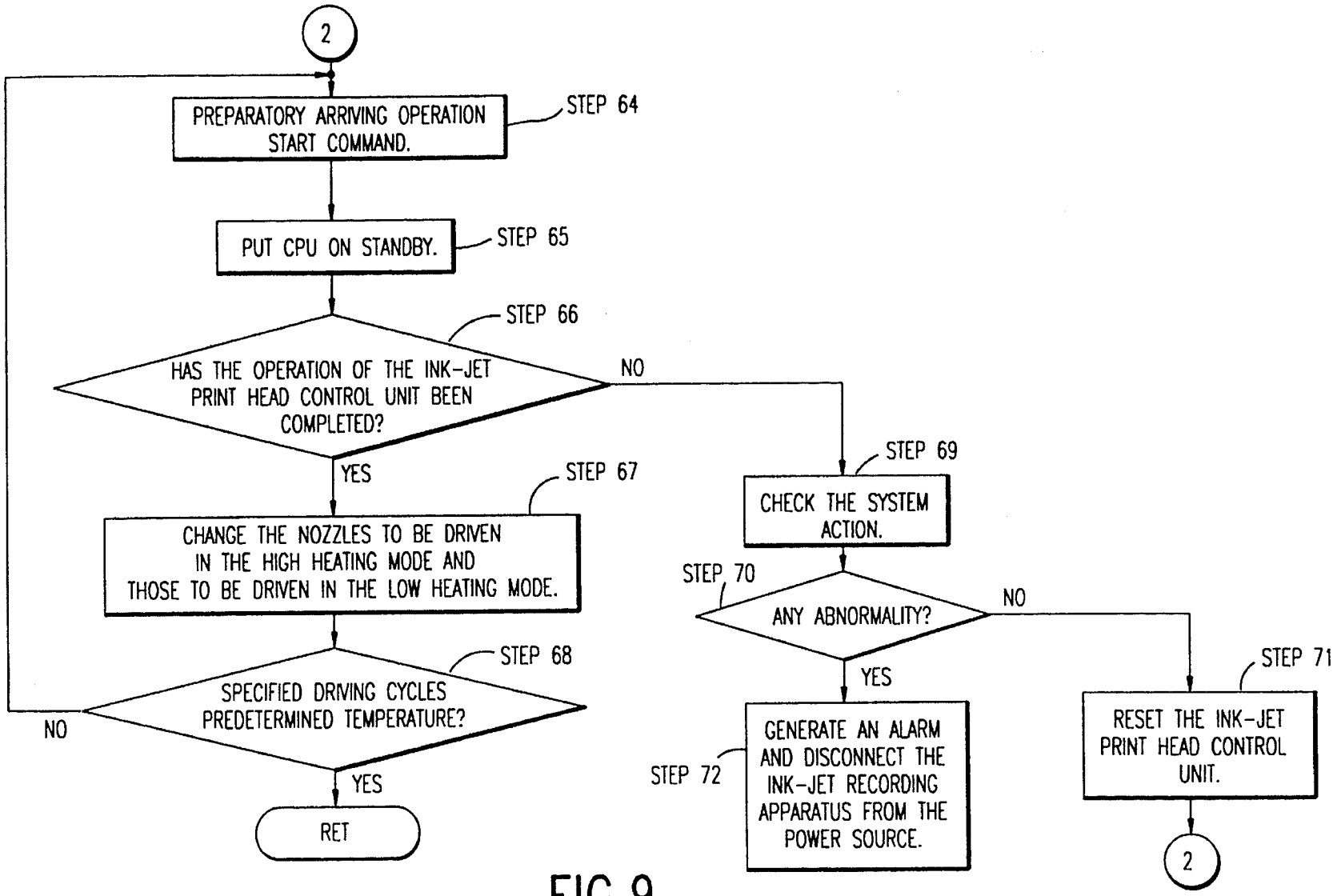
FIGS. 8 and 9 are flow charts of control programs to be executed by the ink-jet print head control unit of FIG. 3 to drive the ink-jet print head for a preparatory operation.

FIG. 1 shows a system comprising an ink-jet recording apparatus 1 in a preferred embodiment according to the present invention comprising a CPU 3, a work RAM 4, a font ROM 5, a program ROM 6, an EEPROM 7, an interface 8, a control panel 9, a memory control unit 10, an image RAM 11, a ink-jet print head control unit 12, an ink jet print head 13, a motor control unit 14, a motor 15, an I/O control unit 16, sensors 17 and a bus 18, and a host computer 2.

The ink-jet recording apparatus 1 is connected to the host computer 2, and data is exchanged between the ink-jet recording apparatus and the host computer 2. The CPU 3 is connected to the work RAM 4, the font ROM 5, the program ROM 6 and the EEPROM 7, and operates according to programs stored in the program ROM on the basis of set data stored in the EEPROM 7, such as correction data for improving print quality. The CPU 3 is connected also to the bus 18 to send control signals through the bus 18 to the individual units of the ink-jet recording apparatus 1. The work RAM 4 serves as a work storage region of the CPU 3, for storing various pieces of information to be processed by the CPU 3. Data representing fonts of characters to be used for printing is stored in the font ROM 5. Programs to be executed by the CPU 3 is stored in the program ROM 6. The EEPROM 7 is a nonvolatile storage storing information including correction data for improving print quality and set data representing the operating modes of the ink-jet recording apparatus 1 and the like and capable of retaining the information in the absence of power. The set data can be set by operating the control panel 9.

The interface is connected to both the host computer 2 and the bus 18 to exchange data directly with the host computer 2. The control panel 9 is connected to the bus 18 to enter input data and to display information indicating the operating conditions and messages.

The memory control unit 10 is connected to the image RAM 11, the bus 18 and the ink-jet print head control unit 12 and controls the image RAM 11. Data representing images to be recorded is stored in the image RAM 11. The storage region of the image RAM 11 may be divided into storage regions for the ink-jet print cartridges 21 of the ink-jet print head 13.

The ink-jet print head control unit 12 is connected to the ink-jet print head 13, the bus 18 and the memory control unit 10 and controls the timing of discharging the ink through each discharge nozzle of the ink-jet print head 13, the temperature of the ink and the like. The ink-jet print head control unit 12 may be capable of carrying out part of the control function of the CPU 3, such as the control of the discharge nozzles on the basis of discharge nozzle selection information, which will be described later. The ink-jet print head 13 consists of a plurality of ink-jet print cartridges 21 each having N discharge nozzles. For example, the ink-jet print head 13 consists of four ink-jet print cartridges 21 respectively for jetting black ink K, cyan ink C, magenta ink M and yellow ink Y for color printing.

The motor control unit 14 is connected to the motor 15 and the bus 18 to control the motor 15. The motor 15 drives a carriage holding the ink-jet print head 13 for movement relative to a recording medium 23, such as a recording sheet. The I/O control unit 16 is connected to the sensors 17 including a sensor for detecting the edge of a recording sheet and a sensor for detecting the width of a sheet, and the bus 18 to control the sensors 17 and to receive signals provided by the sensors 17.

The bus 18 interconnects the CPU 3, the interface 8, the control panel 9, the memory control unit 10, the ink-jet print head control unit 12, the motor control unit 14 and the I/O control unit 16 to transfer data and control signals.

The work RAM 4 and the image RAM 11 may be substituted by a single RAM.

In operation, the CPU 3 operates on the basis of set data stored in the EEPROM 7 according to the control programs stored beforehand in the program ROM 6. When necessary, the CPU 3 uses the work RAM 4. The set data to be stored in the EEPROM 7 is entered by operating the control panel 9. The CPU 3 receives information provided by the sensors 17 through the I/O control unit 16 to decide whether the recording operation is possible or whether the recording operation is impossible, gives an instruction to the motor control unit 14 to move a carriage 22 and to advance the recording sheet and to adjust the ink-jet print head at a recording position.

Recording data, such as image data and character codes, provided by the host computer 2 is transferred through the interface 8 to the CPU 3, and then the CPU converts the recording data according to a print format into recording image data, such as a bit map. For example, when the received recording data is character codes, the CPU 3 converts the character codes into corresponding character image data with reference to the contents of the font ROM 5, and then, the memory control unit 10 stores the character image data in the image RAM 11. Subsequently, the CPU 3 determines a print head driving pulse width and a print head driving mode on the basis of temperatures detected by temperature sensors incorporated into the ink-jet recording apparatus and the ink-jet print cartridges 21, and sets the print head control unit 12 for set values. Since the ink discharging characteristics of the ink-jet print cartridges 21 are unsatisfactory when the respective temperatures of the ink-jet print cartridges 21 are low, a preparatory driving operation is carried out to raise the temperatures of the ink-jet print cartridges 21 to temperatures in an optimum temperature ranges at which the ink discharge characteristics of the ink-jet print cartridges 21 are comparatively stable. Then, the CPU 3 gives a command signal to the motor control unit 12 to move the carriage 22 holding the ink-jet print head 13 along a printing line. A print timing signal provided by an encoder attached to the carriage 22 is given to the CPU 3 and the print head control unit 12. The CPU 3 determines a print start position on the basis of the print timing signal and gives a print enable gate signal to the print head control unit 12, and then the print head control unit 12 gives a print head drive signal based on the print enable gate signal and the print timing signal to the ink-jet print head 13. Upon the completion of printing one print line, the memory control unit 10 sends an interrupt to the CPU 3, and then the CPU 3 sends a signal to the motor control unit 14 to advance the recording medium 23 by one line spacing and to move the carriage 22 along a new line. The foregoing procedure is repeated until the recording medium 23 is printed entirely. The temperature of the ink-jet print head and the environmental temperature are detected every time the carriage 22 is returned and a print head driving pulse signal and a driving mode are determined for each line.

Upon the completion of printing on all the lines of the recording medium 23, the CPU 3 gives a command to the motor control unit 14 to eject the recording medium 23, to move the carriage 22 to a standby position corresponding to a covering mechanism 25 for covering the ink-jet print head 13 to prevent the ink from drying, to cover the ink-jet print head 13. Thus, a series of operations for printing one recording medium 23 is completed.

Figure 2:
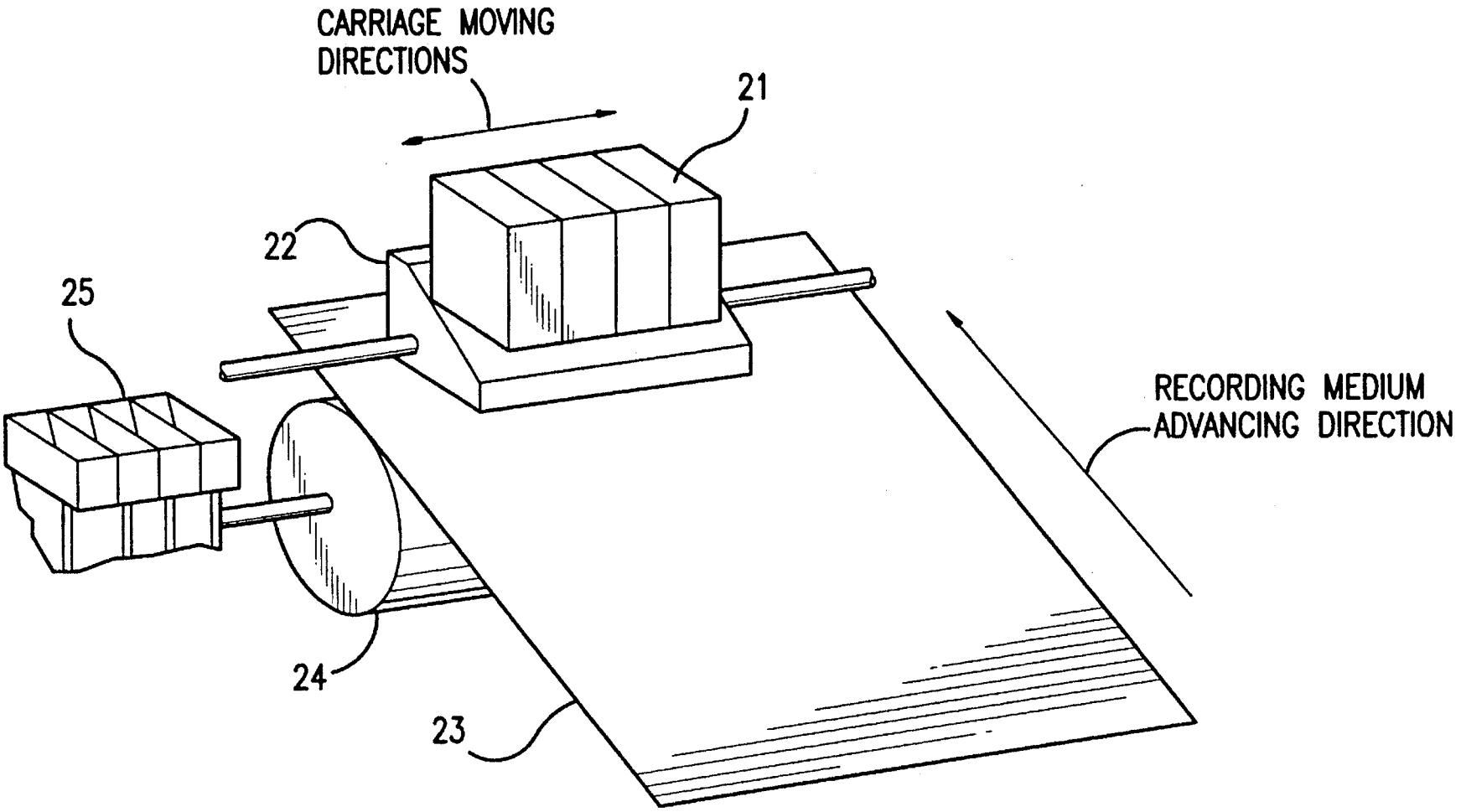
FIG. 2 is a perspective view of a carriage and associated components included in the ink-jet recording apparatus in the preferred embodiment according to the present invention.

FIG. 2 shows the carriage 22 and the associated components of the ink-jet recording apparatus 1. Shown in FIG. 2 are ink-jet print cartridges 21, the carriage 22, the recording medium 23, a platen 24 and the covering mechanism 25. The ink-jet print head 13 mounted on the carriage 22 comprises one or a plurality of ink-jet print cartridges 21, which can be detachably mounted individually or in a unit on the carriage 22. Each ink-jet print cartridge 21 has a plurality of discharge nozzles. When not in use, the ink-jet print cartridges 21 are positioned at the standby position corresponding to the covering mechanism 25 and covered by the covering mechanism 25 to prevent the ink from drying. The covering mechanism 25 may be provided with an ink container for containing the ink discharged through the discharge nozzles for a preparatory operation at the standby position. During the printing operation, the carriage is reciprocated laterally and the ink is discharged through the discharge nozzles for printing. If the ink-jet print head 13 mounted on the carriage 22 comprises the plurality of ink-jet print cartridges 21, ink particles are jetted by the ink-jet print cartridges 21 to form a desired image on the recording medium 23 by ink dots. When the ink-jet print head 21 comprises a black ink-jet print cartridge for discharging black ink, a cyan ink-jet print cartridge for discharging cyan ink, a magenta ink-jet print cartridge for discharging magenta ink and a yellow print head for discharging yellow ink, the ink-jet print head 13 is able to print a color picture on the recording medium. The ink-jet print head 13 may comprise a plurality of ink-jet print cartridges 21 for discharging ink of the same color for gradation printing. The respective printing regions of the ink-jet print cartridges 21 may be dislocated from each other for bold printing.

Every time the carriage 22 is returned, the platen 24 is turned to advance the recording medium 23 by a predetermined distance. Such a printing cycle is repeated to print the recording medium 23 entirely. Then, the carriage is returned to the standby position corresponding to the covering mechanism 25, and the ink-jet print cartridges 21 are covered by the covering mechanism 25 and held on standby for the next printing operation.

The carriage 22 may be moved in the line feed direction relative to the recording medium 23 instead of advancing the recording medium 23 relative to the carriage 22. The recording medium 23 can be advanced by a distance corresponding to one printing width or a predetermined line spacing, or a distance corresponding to a blank space. The recording medium 23 can be advanced according to instructions provided by the CPU 3 to position the recording medium 23 for printing according to a predetermined format. The distance of advancement of the recording medium 23 may be changed by instructions provided by the host computer 2.

Figure 3:
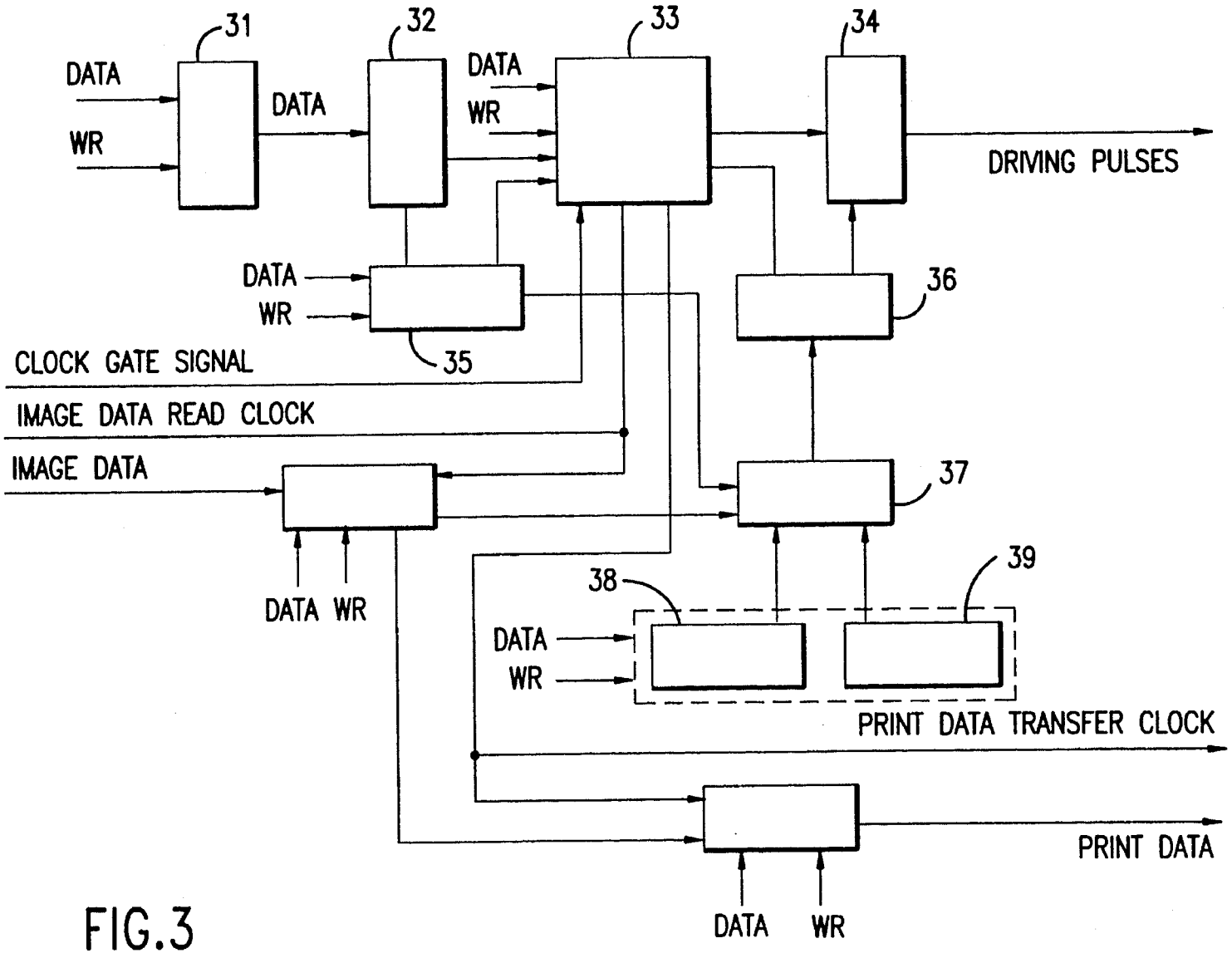
FIG. 3 is a block diagram of an ink-jet print head control unit included in the ink-jet recording apparatus in the preferred embodiment according to the present invention.

FIG. 3 shows an ink-jet print head driving unit included in the ink-jet print head control unit 12 (FIG. 1) of the ink-jet recording apparatus 1. Shown in FIG. 3 are a sequential nozzle group operation period storage 31, a sequential nozzle group operation period setting unit 32, a print timing control unit 33, a print pulse generating unit 34, a dot counter control unit 35, a print pulse width setting unit 36, a data selecting unit 37, a first storage 38, a second storage 39, a density detecting unit 40 and a print data processing unit 41. The plurality of ink-jet print cartridges 21 are controlled in the same manner and hence the operation of the ink-jet print head driving unit for controlling one of the ink-jet print cartridges 21 will be described herein for simplicity.

The discharge nozzles of the ink-jet print cartridge 21 are divided into a plurality of nozzle groups, the discharge nozzles of each nozzle group are driven simultaneously, and the nozzle groups are driven sequentially.

The sequential nozzle group operation period storage 31 stores a sequential nozzle group operation period corresponding to a time interval between the operation of one of the nozzle groups and that of the next nozzle group. The sequential nozzle group operation period is determined by sending data from the CPU 3 to the sequential nozzle group operation period storage 31 and giving a signal WR to the same. The sequential nozzle group operation period setting unit 32 generates a period signal representing a time interval between the operation of one of the nozzle groups and the operation of the next nozzle group on the basis of the sequential nozzle group operation period stored in the sequential nozzle group operation period storage 31 according to an instruction given thereto by the print timing control unit 33, and gives the period signal to the print timing control unit 33 and the dot counter control unit 35. Upon the reception of the period signal from the sequential nozzle group operation period setting unit 32, the dot counter control unit 35 counts the number of the nozzle groups and, upon the coincidence of a count of the nozzle groups counted by the dot counter control unit 35 with the number of all the nozzle groups, the dot counter control unit 35 gives a coincidence signal to the print timing control unit 33 to that effect. Data of a storage device to be selected by the data selecting unit 37 for the preparatory operation of the ink-jet print head 13 is stored in a storage device included in the dot counter control unit 35. This data is provided by the CPU 3 (FIG. 3) or the like and the data is set in response to the signal WR.

The print timing control unit 33 generates a plurality of timing signals. The print timing control unit 33 receives a clock signal and a gate signal from other control units, sequential nozzle group operation period signal from the sequential nozzle group operation period setting unit 32 and the count signal representing the number of the nozzle groups from the dot counter control unit 35, and gives a count read signal and a count clock to the sequential nozzle group operation period setting unit 32 and the print pulse width setting unit 36, a driving start signal to the print pulse generating unit 34, an image data read clock to the image density detecting unit 40 and an external device, and a print data transfer clock to the print data processing unit 41 and the ink-jet print head. The CPU 3 or the like gives data requesting the driving of the ink-jet print head for a preparatory operation and the signal WR directly to the print timing control unit 33.

Upon the reception of the driving start signal from the print timing control unit 33 and a count completion signal from the print pulse width setting unit 36, the print pulse generating unit 34 performs the on-off control of a driving pulse signal. The print pulse width setting unit 36 reads, according to an instruction given thereto by the print timing control unit 33, driving pulse width data selected by the data selecting unit 37, counts the count clock provided by the print timing control unit 33, and gives a count completion signal to the print pulse generating unit 34 upon the coincidence of the count with the driving pulse width data. The data selecting unit 37 selects either the driving pulse width data stored in the first storage 38 or the driving pulse width data stored in the second storage 39 according to image density information provided by the image density detecting unit 40 or information provided by the dot counter control unit 35. The driving pulse width data for which the print pulse width setting unit 36 are provided by the CPU 3 (FIG. 1) or the like and are stored in the first storage 38 and the second storage 39 when the signal WR is given.

The image density detecting unit 40 has a print data buffer for storing divided, simultaneously driven print data and determines print density on the basis of the number of dots to be printed stored in the print data buffer. Image data provided by an external device is stored in the print data buffer according to an image data read clock provided by the print timing control unit 33. The image density detecting unit 40 reads a reference density provided by an external device, for example, the CPU 3 (FIG. 1) in response to the signal WR, compares the print density stored in the print data buffer with the reference density, and gives a signal representing the result of comparison to the data selecting unit 37. The data stored in the print data buffer is transferred to the print data processing unit 41. The print data processing unit 41 receives the print data sent from the image density detecting unit 40 according to a print data transfer clock applied thereto by the print timing control unit 33, and then transfers the print data to the ink-jet print head. Depending on temperature condition for the ink-jet print head, the print data processing unit 41 sets the print data at an optional nozzle position for at least one nozzle among the nozzle group when the print data processing unit 41 receives a signal indicating that there is no print data for the nozzle group, and produces print data for the preparatory operation of the ink-jet print head. The print data produced by the print data processing unit 41 can be selectively set for an optional nozzle regardless of the image density and image data. Data representing a mode, the number of nozzles and positions of the nozzles are provided by the CPU 3 (FIG. 1) or the like and read in response to the signal WR.

Operation for driving and controlling the ink-jet print head for printing will be described hereinafter. During printing operation, the temperature of the ink-jet print head is controlled by a preparatory driving operation so as to be within an optimum temperature range. Since the temperature of the ink-jet print head is within the optimum temperature range, the selection of the data stored in the second storage 39, the decision of print density by the image density detecting unit 40 and the print data producing operation of the print data processing unit 41 are inhibited.

When print data to be printed is stored in the image RAM 11 (FIG. 1), the temperature detecting unit detects the temperature of the ink-jet print head, and an optimum driving pulse width data T representing a driving pulse width meeting the temperature condition of the ink-jet print head is set in the first storage 38.

When a print gate signal and a print timing signal (clock signal) are given to the ink-jet print head driving unit from an external device, the print timing control unit 33 provides a signal requesting the transfer of a sequential nozzle group operation period Tp (sec) from the sequential nozzle group operation period storage 31 to the sequential nozzle group operation period setting unit 32, and the same signal is used for setting driving pulse width data in the print pulse width setting unit 36.

Simultaneously with the application of a count clock to the sequential nozzle group operation period setting unit 32 and the print pulse width setting unit 36 by the print timing control unit 33, the print pulse provided by the print pulse generating unit 34 goes HIGH to supply a current to the heater of the ink-jet print head. Upon the coincidence of a count of count clock counted by the print pulse width setting unit 36 with the set driving pulse width data, the print pulse width setting unit 36 gives a count completion signal to the print pulse generating unit 34 and, consequently, the print pulse goes LOW to terminate the supply of current to the heater of the ink-jet print head. The width of the print pulse thus produced is T sec. The heater heats the ink-jet print head for T sec to produce bubbles within the nozzles so that the ink is jetted. Upon the coincidence of a count of the count clock with the sequential nozzle group operation period Tp, the sequential nozzle group operation period setting unit 32 decides that the control of the printing operation of one of the nozzle groups is completed, gives one clock to the dot counter control unit 35 to manage the current number of dots, and gives a completion signal to the print timing control unit 33.

Upon the reception of the completion signal from the sequential nozzle group operation period setting unit 32, the print timing control unit 33 provides a print start signal to repeat the foregoing operations for the next printing cycle. Upon the coincidence of a count counted by the dot number counter control unit 35 with the number of all the nozzles, the print start operation of the print timing control unit 33 is inhibited. All the nozzles are driven by the foregoing series of operations. Print pulses of a pulse width of T sec are provided respectively for the driven nozzle groups at a period of Tp sec by the foregoing series of operations to print an image by discharging the ink. The series of operations is repeated continuously for each recording line on the recording medium, the recording medium is advanced by a distance corresponding to the nozzle width, the series of operations is repeated to complete printing the recording medium.

The selection of the data stored in the second storage 39, the decision of the print density by the image density detecting unit 40 and the print data producing operation of the print data processing unit 41 which are inhibited when the temperature of the ink-jet print head is in the optimum temperature range are executed when the temperature of the ink-jet print head and the environmental temperature are not within the optimum temperature range. For example, the signal representing an image density provided by the image density detecting unit 40 is given as a data selection signal to the data selecting unit 37 to select the driving pulse width data stored in either the first storage 38 or the second storage 39 when the temperature of the ink-jet print head is higher than the upper limit of the optimum temperature range or the temperature of the ink-jet print head drops below the lower limit of the optimum temperature range due to very low environmental temperature. When the temperature of the ink-jet print head drops below the lower limit of the optimum temperature range, for example, when the ink-jet recording apparatus is operated in an environment of a very low temperature, the print data processing unit 41 produces print data for the nozzle groups to which any image data to be printed is not allocated, and the nozzles are driven on the basis of the driving pulse width data, which does not cause the nozzles to discharge the ink, stored in the second storage 39.

Figure 4:
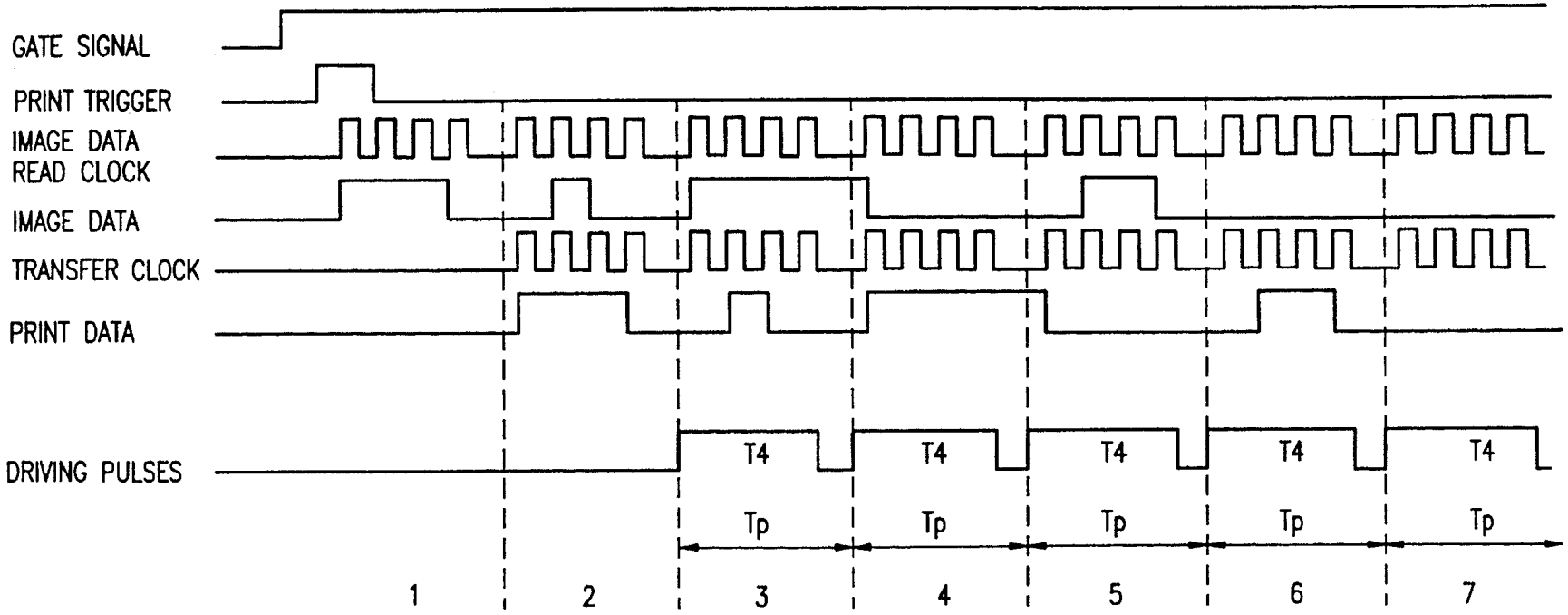
FIG. 4 is a time chart comparatively showing a set of signals provided by the ink-jet print head control unit of FIG. 3 when the temperature of the ink-jet print head is in an optimum temperature range.

Referring to FIG. 4 showing the output signals of the ink-jet print head control unit in a time chart, when the gate signal goes HIGH and a print trigger signal is given to the print timing control unit 33, the print timing control unit 33 gives an image data read clock to the memory control unit 10. Then, the memory control unit 10 provides image data in synchronism with the image data read clock and the image data is stored temporarily in the data buffer of the image density detecting unit 40 in synchronism with the image data read clock to store the image data beforehand.

The print data is transferred through the print data processing unit 41 to the ink-jet print head in synchronism with a print data transfer clock. The ink-jet print head reads the print data at the trailing edge of the print data transfer clock and stores in a register, and a current is supplied to the heaters for the nozzles to be used for printing according to a driving pulse provided by the print pulse generating unit 34. In this embodiment, each nozzle group has four nozzles. Accordingly, the driving pulse is provided after 4-bit print data has been transferred to the register of the ink-jet print head. When the number of all the nozzles is 128, such a control operation for the 4-bit print data is repeated thirty-two times. For example, the print data read beforehand by the image density detecting unit 40 at a stage ① is transferred from the image density detecting unit 40 to the ink-jet print head at a stage ②, and the ink is discharged to print the print data actually at a stage ③.

As mentioned above, the ink-jet print head is drive for a preparatory operation to avoid unsatisfactory printing and to prevent the unsuccessful discharge of the ink prior to the foregoing printing operation. A procedure of driving the ink-jet print head for a preparatory operation will be described hereinafter.

As mentioned above, all the nozzles of the ink jet print head are divided into the nozzle groups each of four nozzles, and the four nozzles of each nozzle group are driven simultaneously. For example, when the ink-jet print head has 128 nozzles, the nozzle driving cycle is repeated thirty-two times to drive all the nozzles. In the nozzle driving cycle for driving the four nozzles, the four nozzles are driven so that the ink will be discharged or the ink will not be discharged to raise the temperature of the ink-jet print head or to drive the nozzles for a preparatory operation for clearing the ink clogging the nozzles. The nozzle groups can be driven so that the ink will be discharged or the ink will not be discharged depending on the environmental temperature. The print data can be allocated to only desired nozzles among those of the nozzle group to discharge the ink through only the desired nozzles. Since control operations respectively for discharging the ink, not discharging the ink and allocating print data to the nozzles can be executed for each nozzle group and these control operations can be executed in combination during the nozzle driving cycles for driving all the nozzles, the ink-jet print head can be quickly driven for a preparatory operation according to the condition of the ink-jet print head.

As mentioned above, the unsuccessful discharge of the ink occurs when the ink-jet recording apparatus is operated after the same has been held inoperative for a long time or when the ink-jet recording apparatus is used in a cold environment. The preparatory driving mode must be selectively determined taking into consideration the condition of the ink-jet recording apparatus. For example, if the ink-jet recording apparatus held is to be operated in a cold environment after the same has been held inoperative for a long time, the ink-jet print head needs both the preparatory driving operation for heating and the preparatory driving operation for clearing the ink clogging the nozzles. If the ink-jet recording apparatus is to be operated in a desirable environment meeting predetermined conditions after the same has been held inoperative for a long, the preparatory driving operation for clearing the ink clogging the nozzles is more important than the preparatory driving operation for heating the ink-jet print head. If the ink-jet recording apparatus held inoperative for a short time is to be operated in an cold environment, the preparatory driving operation for heating the ink-jet print head is more important than the preparatory driving operation for clearing the ink clogging the nozzles. When heating the ink-jet print head, the ink-jet print head can be driven alternately in a high heating mode in which the ink is discharged and a low heating mode in which the ink will not be discharged. In the high heating mode, a relatively large amount of energy is supplied to the ink-jet print head for relatively high heating effect, which, however, wastes a relatively large amount of the ink. When clearing the ink clogging the nozzles, the ink-jet print head is heated to reduce the viscosity of the ink, and then the ink is discharged. The preparatory driving operation in the high heating mode and the preparatory driving operation in the low heating mode are applied selectively to the nozzle groups of the ink-jet print head according to the condition of the ink-jet print head to drive the nozzles properly for a preparatory operation.

Preparatory driving modes will be described hereinafter.

A mode of a preparatory driving operation for driving the ink-jet print head when the ink-jet recording apparatus is to be operated in a cold environment after the same has been held inoperative for a long time will be described with reference to FIGS. 1, 3 and 5. This mode requires the preparatory driving operation for both heating the ink-jet print head in the low heating mode and clearing the ink clogging the nozzles in the high heating mode. Therefore, a relatively large number of the nozzles are driven to clear the ink clogging the nozzles and to heat the ink-jet print head quickly.

For example, the nozzle groups of odd numbers and those of even numbers may be driven respectively in the high heating mode and the low heating mode. First driving pulse width data T (sec) for the high heating mode is stored in the first storage 38 and second driving pulse width data T' (sec) for the low heating mode is stored in the second storage 39. Either the first or second driving pulse width data is selected and the nozzles are driven according to the selected driving pulse width data. Suppose that the nozzle groups of odd numbers are driven in the high heating mode and the nozzle groups of even numbers are driven for low heating mode. Then, the dot counter control unit 35 requests the data selecting unit 37 to select the first driving pulse width data stored in the first storage 38 prior to the printing operation of the nozzle groups of odd numbers. The second driving pulse width data for the low heating mode stored in the second storage 39 is selected to drive the nozzle groups of even numbers for a preparatory operation. During the preparatory driving operation, instructions given to the data selecting unit 37 by the image density detecting unit 40 are invalid. The print data processing unit 41 sets print data so that all the nozzles of each nozzle group are driven. Subsequently, a print trigger is produced to start the preparatory driving operation. A command to produce the print trigger is given through the data bus of the CPU 3 to the print timing control unit 33.

Figure 5:
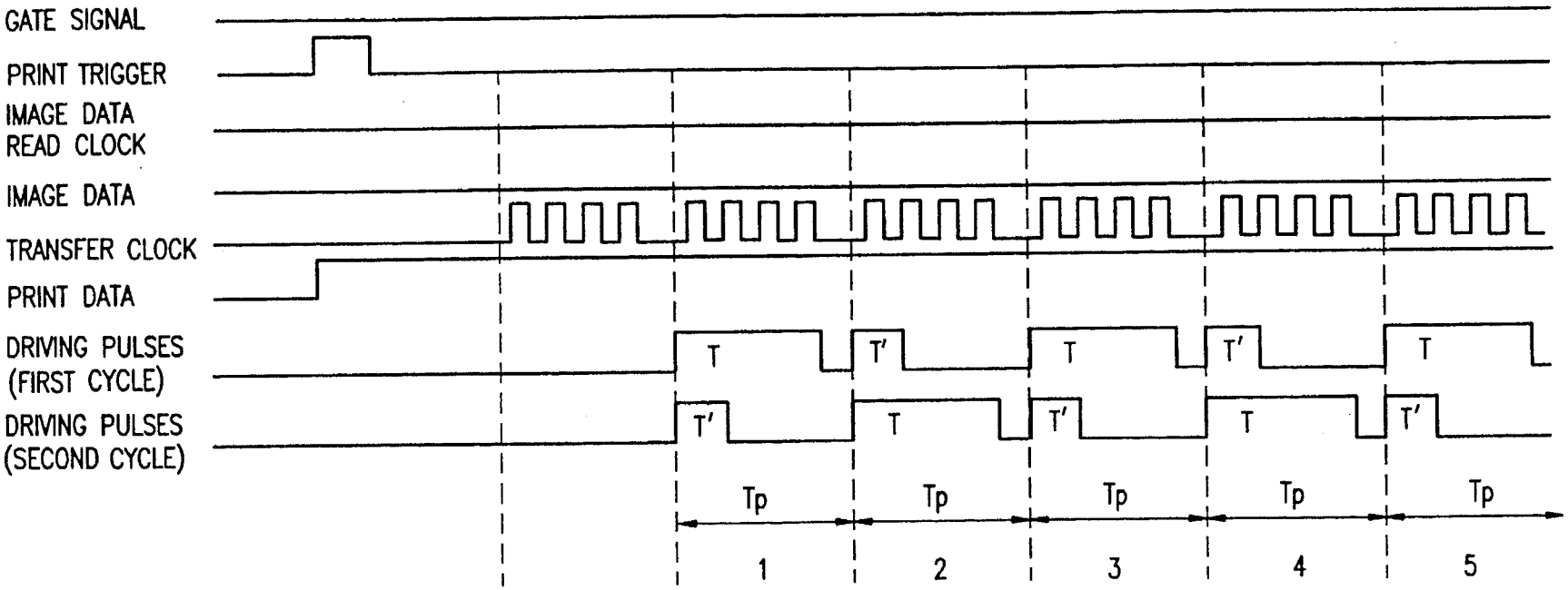
FIG. 5 is a time chart comparatively showing a set of signals provided by the ink-jet print head control unit of FIG. 3 when starting the ink-jet recording apparatus in a cold environment after the same has been held inoperative for a long time.

FIG. 5 is a time chart showing a set of output signals of the ink-jet print head control unit to be provided when operating the ink-jet recording apparatus in a cold environment after the same has been held inoperative for a long time. As shown in FIG. 5, the gate signal remains LOW, no image data is given and no image data read clock is generated. As mentioned above, the image trigger is generated when the CPU 3 requests the same. A transfer clock is generated. The print data processing unit 41 sets the print data so that all the nozzles are driven. A first driving pulse timing signal, i.e., the upper one of driving pulse timing signals shown in FIG. 5, determines the timing of discharging the ink through the nozzles of the nozzle groups of odd numbers, and a second driving pulse timing signal, i.e., the lower driving pulse timing signal in FIG. 5, determines the timing of discharging the ink through the nozzles of the nozzle groups of even numbers. The first driving pulse timing signal makes the ink-jet print head control unit drive the nozzles so that the ink is discharged at stages ①, ③ and ⑤, and drive the nozzles so that the ink will not be discharged at stages ② and ④. Similarly, the second driving pulse timing signal makes the ink-jet print head control unit drive the nozzles so that the ink is discharged at the stages ② and ④, and drive the nozzles so that the ink will not be discharged at the stages ①, ③ and ⑤. The dot counter control unit 35 can be set for a preparatory driving mode in which the ink is discharged through all the nozzles of the nozzle groups of odd numbers, and then the ink is discharged through all the nozzles of the nozzle groups of even numbers. In this preparatory driving mode, all the nozzles can be driven to discharge the ink by two preparatory driving cycles. The ink-jet print head can be quickly heated by repeating the preparatory driving operation in this preparatory driving mode several times, and the number of ink discharging cycles is far smaller than that necessary for clearing the ink clogging the nozzles simply by discharging the ink through the nozzles. This preparatory driving mode is very effective on the reduction of wasteful consumption of the ink.

Only optional nozzle groups among all the nozzle groups may be driven for a preparatory operation instead of alternately driving the nozzle groups of odd numbers and those of even numbers in the foregoing preparatory driving mode. In the former case, information representing the positions of the nozzle groups to be driven for the preparatory operation is stored beforehand in the storage device of the dot counter control unit 35.

Figure 6:
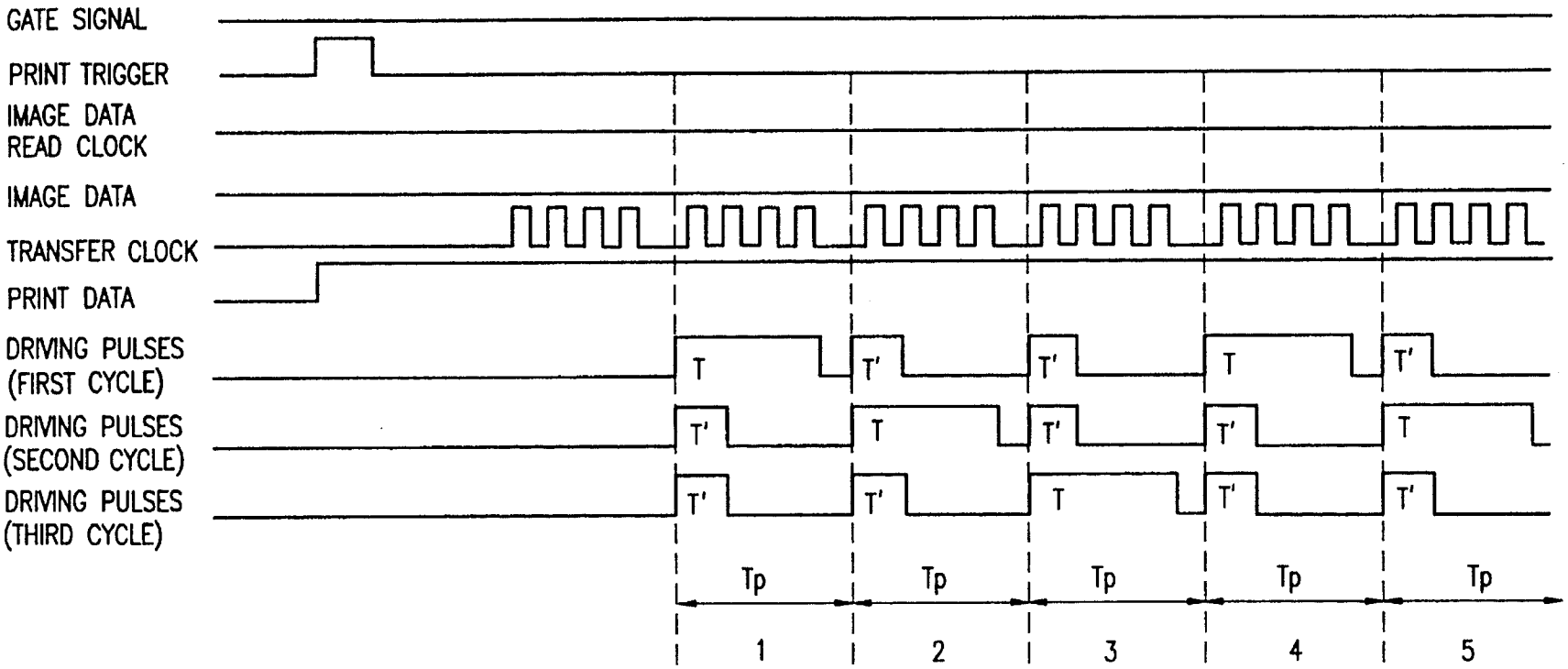
FIG. 6 is a time chart comparatively showing another set of signals provided by the ink-jet print head control unit of FIG. 3 when starting the ink-jet recording apparatus in a cold environment after the same has been held inoperative for a long time.

FIG. 6 is a time chart showing another set of output signals of the ink-jet print head control unit to be provided when operating the ink-jet recording apparatus in a cold environment after the same has been held inoperative for a long time. In this example, one nozzle group out of a set of three nozzle groups is driven at a time, and the three nozzle groups of each set of nozzle groups are driven sequentially in response to a first driving pulse timing signal, i.e., the upper driving pulse timing signal in FIG. 6, a second driving pulse timing signal, i.e., the middle driving pulse timing signal in FIG. 6, and a third driving pulse timing signal, i.e., the lower driving pulse timing signal in FIG. 6. The first driving pulse timing signal makes the ink-jet print head control unit drive a first nozzle group of the set of three nozzle groups at stages ① and ④, the second driving pulse timing signal makes the ink-jet print head control unit drive a second nozzle group of the set of three nozzle groups at stages ② and ⑤, and the third driving pulse timing signal makes the ink-jet print head control unit drive a third nozzle group of the set of three nozzle groups at a stage ③ so that the ink will be discharged Thus, the ink is discharged through all the nozzles by the three preparatory driving cycles respectively using the first, second and third driving pulse timing signals.

Figure 7:
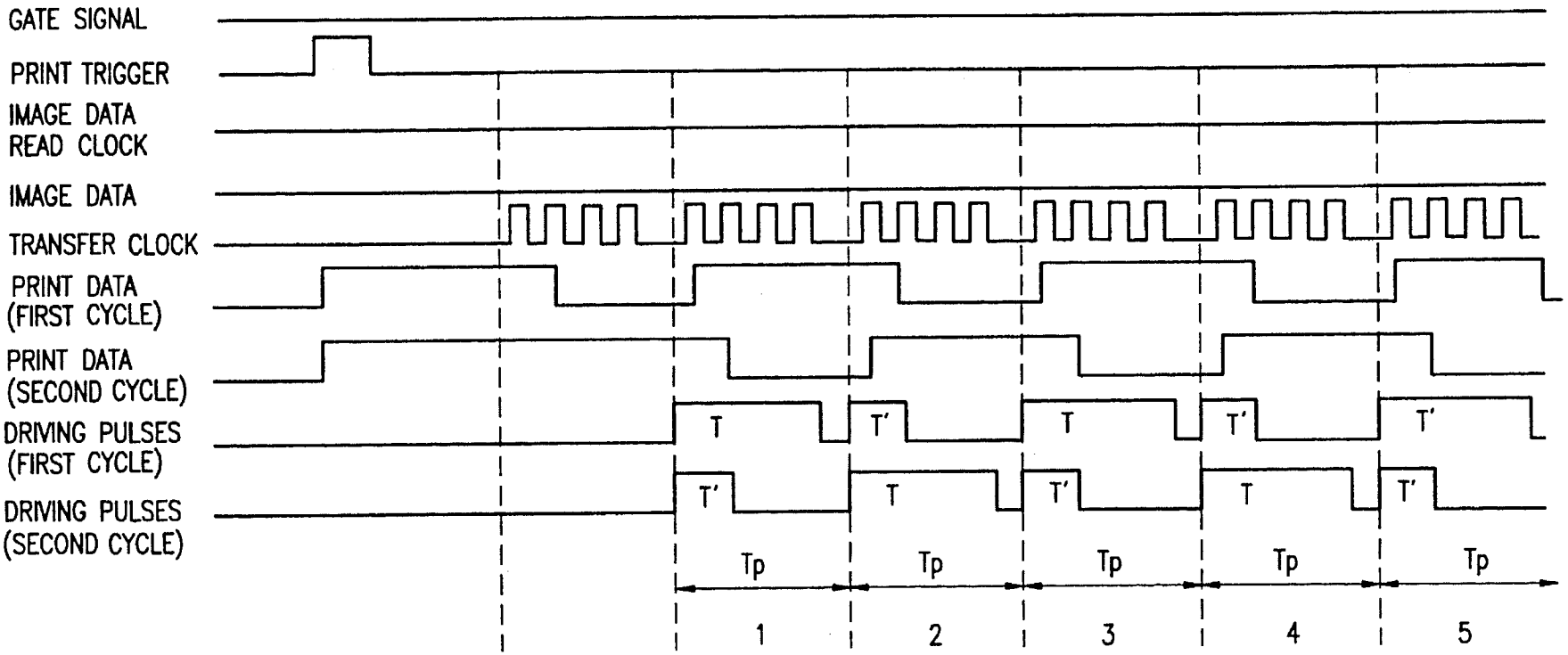
FIG. 7 is a timing chart comparatively showing a set of signals provided by the ink-jet print head control unit of FIG. 3 when starting the ink-jet recording apparatus in an environment of a temperature in an optimum temperature range after the same has been held inoperative for a long time.

FIG. 7 is a time chart showing a set of output signals of the ink-jet print head control unit to be provided when the ink-jet recording apparatus is to be operated at an environmental temperature in an optimum temperature range after the same has been held inoperative for a long time. In this case, a preparatory driving mode in which the ink clogging the nozzles is cleared is more important than a preparatory driving mode in which the ink-jet print head is heated. Since the temperature of the ink-jet print head is in the optimum temperature range, the ink-jet print head need not quickly be heated. However, the ink clogging the nozzles can be cleared more effectively by repeating the ink discharging cycle by less times when the ink discharge cycle is repeated heating the ink-jet print head to some extent.

In the preparatory driving operation using the signals shown in FIG. 7, the nozzle groups may be divided into a set of those of odd numbers and a set of those of even numbers, and then each nozzle group may be heated alternately in the high heating mode and the lower heating mode. The first driving pulse width data T (sec) for heating the nozzle groups in the high heating mode is stored in the first storage 38, and the second driving pulse width data T' (sec) for heating the nozzle groups in the low heating mode is stored in the second storage 39. Either the first driving pulse width data T or the second driving pulse width data T' is selected and the ink-jet print head is driven for a preparatory operation according to the selected driving pulse width data. A procedure of selecting either the first driving pulse width data T or the second driving pulse width data T' is stored beforehand in the storage device of the dot counter control unit 35, and the data selecting unit 37 selects either the first driving pulse width data T or the second driving pulse width data T'. Suppose that the nozzle groups of odd numbers are driven in the high heating mode for a preparatory operation and the nozzle groups of even numbers are driven in the low heating mode for a preparatory operation. Then, the dot counter control unit 35 gives an instruction to the data selecting unit 37 before the printing operation of the nozzle groups of odd numbers to select the first driving pulse width data T stored in the first storage 38. The second driving pulse width data T' stored in the second storage 39 is selected for driving the nozzle groups of even numbers for a preparatory operation. Request given to the data selecting unit 37 by the image density detecting unit 40 is invalid during the preparatory driving of the nozzle groups. The print data processing unit 41 selectively determines the nozzles through which the ink is to be discharged among those of each nozzle group, in which it is desirable to discharge the ink through a relatively small number of the nozzles to avoid the sharp increase of the temperature of the ink-jet print head. All the nozzles are thus driven several times so that each nozzle is driven at least once in the high heating mode to clear all the nozzles of the ink.

Referring to FIG. 7, the print data is determined so that a first nozzle of each nozzle group is driven in the high heating mode and all the nozzles of the nozzle groups to be driven in the low heating mode are driven. It is preferable, for heating the ink-jet print head uniformly, to drive the nozzle groups sequentially in the high heating mode on the basis of first print data. As mentioned above, the nozzle groups of odd numbers and the nozzle groups of even numbers may be alternately driven for a preparatory operation. When each nozzle group has four nozzles, a first nozzle of each of the nozzle groups of odd numbers is driven in the high heating mode in the first preparatory driving cycle, a first nozzle of each of the nozzle groups of even numbers is driven in the high heating mode in the second preparatory driving cycle, a second nozzle of each of the nozzle groups of odd numbers is driven in the high heating mode in the third preparatory driving cycle. Thus, each of all the nozzles are driven once in the high heating mode and all the nozzles are driven sequentially in the high heating mode in eight preparatory driving cycles. The first preparatory driving cycle uses a first print data and a first driving pulse timing signal, and the second preparatory driving cycle uses a second print data and a second driving pulse timing signal as shown in FIG. 7. Different print data are used for the third to eighth preparatory driving cycles. Some nozzles of each nozzle group may be selectively driven in the low heating mode or all the nozzles of each nozzle group may be driven in the low heating mode, which is more effective on the suppression of the rise of the temperature of the ink-jet print head during the preparatory operation of the ink-jet print head.

When the ink-jet recording apparatus is used in a cold environment after the same has been held inoperative for a short time, preparatory driving for heating the ink-jet print head is more important than the preparatory driving operation for clearing the ink clogging the nozzles. As mentioned above, the ink-jet print head can be heated by driving the nozzles. In this case, the preparatory driving operation in the high heating mode to discharge the ink through the nozzles need not necessarily be performed. However, preparatory driving in the high heating mode is able to heat the ink-jet print head quickly whereas the same increases the wasteful consumption of the ink. All the nozzles may be driven for a preparatory operation in the low heating mode. In this case, data making the data selecting unit 37 select the second driving pulse width data stored in the second storage 39 is stored beforehand in the storage device of the dot counter control unit 35. Although the ink is not wasted when all the nozzles are driven for a preparatory operation in the low heating mode, the ink-jet print head cannot be quickly heated. The preparatory driving mode is determined selectively taking into consideration the environmental temperature and the advantages and disadvantages of the foregoing preparatory driving modes.

Thus, the nozzles of the ink-jet print head can be driven for a preparatory operation in a preparatory driving mode meeting the condition of the ink-jet print head by driving the nozzles in the high heating mode and/or the low heating mode and properly setting print data. Since the driving pulse width for heating the nozzles in the high heating mode and the driving pulse width for heating the same in the low heating mode are determined on the basis of the first driving pulse width data stored in the first storage 38 and the second driving pulse width data stored in the second storage 39, the nozzle groups can be driven quickly by either a driving pulse signal of a pulse width specified by the first driving pulse width data or a driving pulse signal of a pulse width specified by the second driving pulse width data. When the processing time for each nozzle group is comparatively long, the driving pulse width data may be directly given to the print pulse width setting unit 36 by the CPU 3 or the like.

During the preparatory driving operation, the temperature of the ink-jet print head and preparatory driving cycles may be monitored by the CPU 3 because the CPU 3 needs to execute only a few control operations in addition to those for controlling the preparatory driving operation during the preparatory driving operation.

Figure 8:
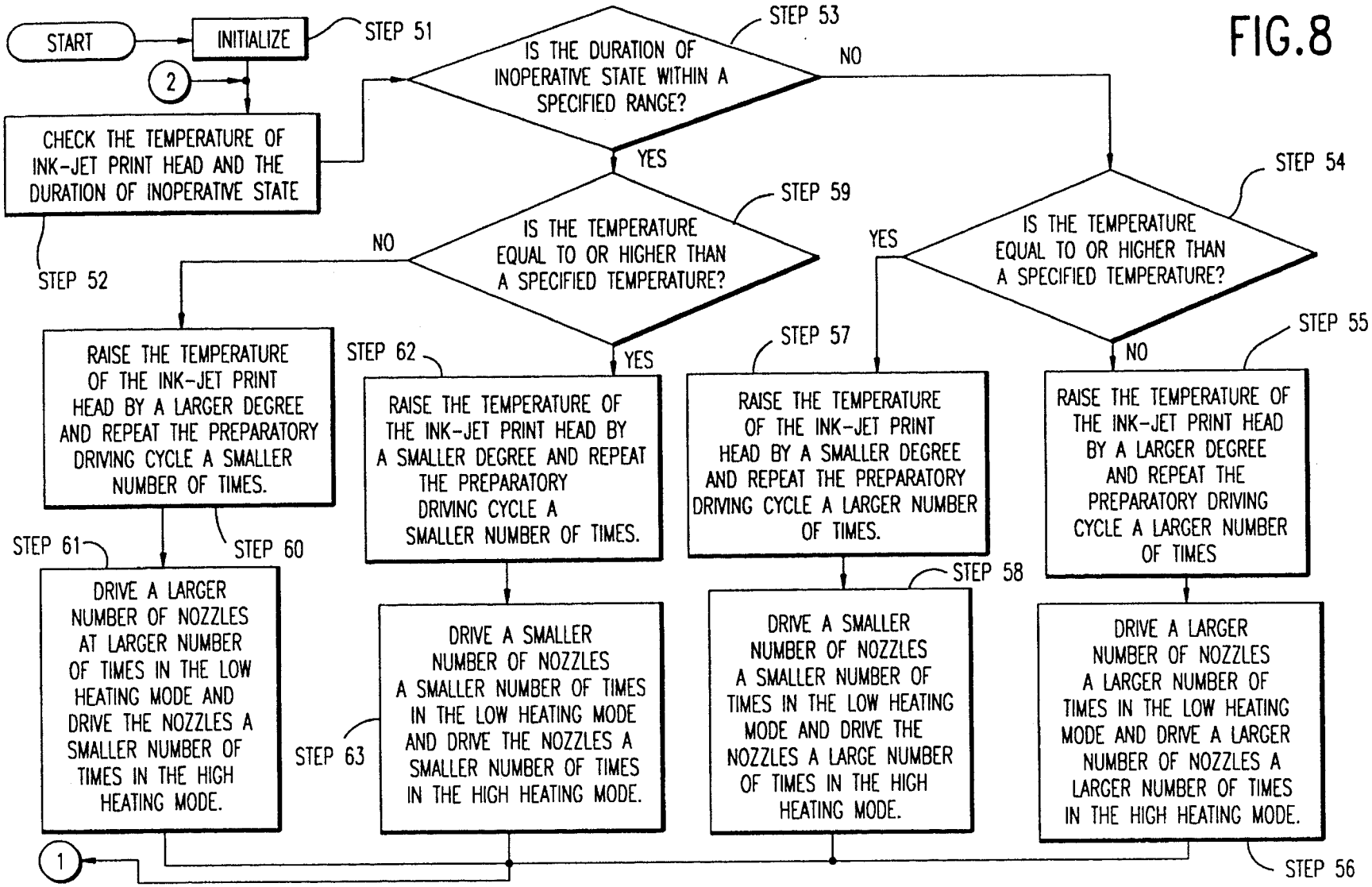
Figure 9:
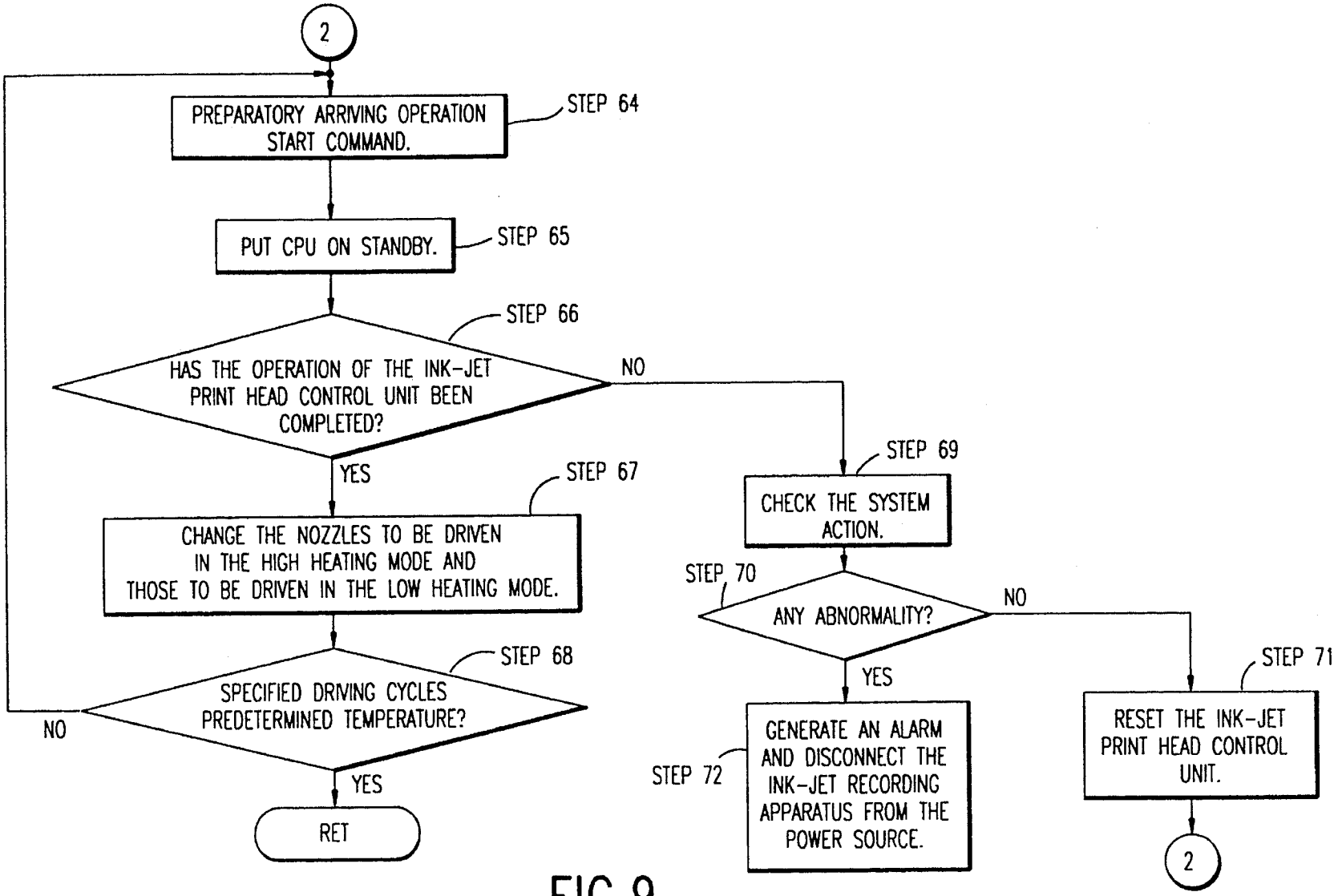

FIGS. 8 and 9 are flow charts of a procedure of the preparatory driving operation, in which a connector ① in FIG. 8 is a point of exit, a connector ① in FIG. 9 is a point of entry corresponding to the point of exit in FIG. 8, a connector ② in FIG. 8 is a point of entry, and a connector ② in FIG. 9 is a point of exit corresponding to the point of entry in FIG. 8.

Referring to FIGS. 8 and 9, the ink-jet recording apparatus is initialized and the ink-jet head control unit is reset in step 51. In step 52, the temperature of the ink-jet print head is detected by the temperature sensor mounted on the ink-jet print head and the duration of inoperative state is checked. The duration of inoperative state may be checked from time measured by a built-in clock, on the basis of the temperature of the ink-jet print head and the environmental temperature or by means of a know method. In step 53, a query is made to see if the duration of inoperative state is shorter than a specified period of time. The routine goes to step 54 if the response in step 53 is negative, i.e., if the ink-jet print head has been held inoperative for a time longer than the specified period of time, or the routine goes to step 59 if the response in step 53 is affirmative.

In step 54, a query is made to see if the temperature of the ink-jet print head is equal to or higher than a specified temperature. If the response in step 54 is negative, it is decided that the ink-jet recording apparatus is to be operated in a cold environment and the routine goes to step 55. In steps 55 and 56, the foregoing preparatory driving procedure of driving the ink-jet print head to be operated in a cold environment after the same has been held inoperative for a long time for a preparatory operation must be conducted. In steps 55 and 56, the number of preparatory driving cycles is set and the dot counter control unit 35 and the print data processing unit 41 are set for values to drive a comparatively large number of the nozzles in the high heating mode in order that the ink-jet print head is heated quickly and to perform a comparatively large number of preparatory driving cycles.

If the response in step 54 is affirmative, the routine goes to step 57, in which the foregoing preparatory driving procedure of driving the ink-jet print head to be operated in an environment of an optimum temperature after the same has been held inoperative for a long time must be conducted. In steps 57 and 58, the number of preparatory driving cycles is set and the dot counter control unit 35 and the print data processing unit 41 are set for values to drive a comparatively large number of the nozzles in the high heating mode so that the temperature of the ink-jet print head will not rise so far and the principal effect of the preparatory driving operation is the clearance of the ink clogging the nozzles.

If the response in step 53 is affirmative, i.e., if it is decided that the ink-jet recording apparatus has been held inoperative for a relatively short time, a query is made in step 59 to see if the temperature of the ink-jet print head is equal to or higher than the specified temperature. If the response in step 59 is negative, the routine goes to steps 60 and 61, in which the number of preparatory driving cycles is set and the dot counter control unit 35 and the print data processing unit 41 are set for values so that the principal effect of the preparatory driving operation is the heating of the ink-jet print head. If the response in step 59 is affirmative, the routine goes to steps 62 and 63, in which the dot counter control unit 35 and the print data processing unit 41 are set for values so that the effect of the preparatory driving operation on the heating of the ink-jet print head and on the clearance of the ink clogging the nozzles is limited to the least extent. It is also possible to set conditions for the preparatory driving operation in steps 62 and 63 so that the preparatory driving operation is not substantially conducted; for example, the print data processing unit 41 may be controlled so as to produce print data which holds all the nozzles inoperative or the preparatory driving operation may be discontinued at this stage and the normal printing operation may be started.

Then, in step 64, a preparatory driving operation start command is given to the print timing control unit 33, and then the ink-jet print head control unit starts the preparatory driving operation. During the preparatory driving operation, the CPU 3 is held on standby in step 65. The CPU 3 can be put on standby by a known method, such as a method that puts the CPU 3 on standby after the elapse of a predetermined time period, a method that continuously monitors an end signal provided by the ink-jet print head control unit or a method that puts the CPU 3 in an interrupt state. Then, in step 66, a query is made to see if the operation of the ink-jet print head control unit has been completed. If the response in step 66 is affirmative, the nozzles to be driven in the high heating mode and the low heating mode are changed and the print data is changed, if necessary, in step 67. In step 68, a query is made to see if the preparatory driving cycle has been repeated specified times and, when the ink-jet recording apparatus is to be operated in a cold environment, to see if the ink-jet print head has been heated to a predetermined temperature. If the response in step 68 is negative, the routine returns to step 64 to repeat the preparatory driving cycle. If the response in step 68 is affirmative, the preparatory driving operation is terminated and the normal printing operation is started.

If the response in step 66 is negative, the system action is checked in step 69, a query is made in step 70 to see if any abnormality is found in the system action. If the response in step 70 is affirmative, an alarm is generated and the ink-jet recording apparatus is disconnected from the power source in step 72. If the response in step 70 is negative, the routine returns to step 52 to carry out the following steps again.

Thus, the CPU 3 carries out the preparatory driving operation, monitoring the temperature of the ink-jet print head and the number of repetition of the preparatory driving cycles.

Although the invention has been described as applied to an ink-jet recording apparatus, the present invention is applicable also to ink-jet print heads incorporated into facsimile equipments and copying machines.

As is apparent from the foregoing description, the present invention is capable of carrying out the preparatory driving operation simultaneously in the high heating mode in which the nozzles of the ink-jet print head are heated so that the ink clogging the nozzles is discharged and in the low heating mode in which the nozzles are heated without discharging the ink, so that the preparatory driving operation can be quickly completed. Since the number of the nozzles to be driven in the high heating mode is increased when the ink-jet recording apparatus is to be started in a cold environment, the preparatory driving operation can be completed in a short time far shorter than that necessary for the conventional preparatory driving method to complete the preparatory driving operation. Since the ink is discharged for preparatory operation while the ink-jet print head is heated, the number of ink discharge cycles necessary for a preparatory operation is far less than that of ink discharge cycles required by the conventional preparatory driving method which clears the ink clogging the nozzles simply by discharging the ink, which suppresses the wasteful consumption of the ink.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. An ink-jet recording apparatus comprising:

a carriage capable of traveling relative to a recording medium; and an ink-jet print head detachably mounted on the carriage and comprising a plurality of ink-jet print cartridges each having a plurality of nozzles, said nozzles being divided into a plurality of nozzle groups, said nozzle groups being driven sequentially at intervals so as to discharge the ink to print a line on the recording medium, wherein said ink-jet print head is in a position out of alignment with said recording medium during a preparatory operation;

a first storage means for storing first driving pulse width data representing the width of first nozzle driving pulses;

a second storage means for storing second driving pulse width data representing the width of second nozzle driving pulses; and a plurality of driving pulse generating units, respectively corresponding to the ink-jet print cartridges, that generate driving pulses of a width represented by either the first driving pulse width data or the second driving pulse width data to drive the nozzle groups of the corresponding ink-jet print cartridges for said preparatory operation;

wherein the driving pulses of a width represented by the first driving pulse width data are used selectively and alternately for driving a first nozzle group in a high heating mode in which the ink is discharged, while the driving pulses of a width represented by the second driving pulse width data are simultaneously and correspondingly used selectively and alternately for driving neighboring nozzle groups in a low heating mode in which the ink is not discharged, both the driving pulses of a width represented by the first driving pulse width data and the driving pulses of a width represented by the second driving pulse width data being used at least once in said preparatory operation in which all the nozzle groups of each ink-jet print cartridge are driven.

2. An ink-jet recording apparatus according to claim 1, further comprising means for setting to different values print data to be applied to the nozzle group driven for a preparatory operation by driving pulses of a width represented by the first driving pulse width data or the second driving pulse width data.

3. An ink-jet recording apparatus according to claim 1, wherein each of the plurality of nozzles of an optional one of the plurality of ink-jet print cartridges is driven once in one preparatory driving cycle requested by an external controller.

* * * * *